US008794549B2

(12) United States Patent
Sakai

(10) Patent No.: US 8,794,549 B2
(45) Date of Patent: Aug. 5, 2014

(54) FUEL INJECTION VALVE OF INTERNAL COMBUSTION ENGINE

(75) Inventor: Hiroyuki Sakai, Gotemba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 819 days.

(21) Appl. No.: 13/062,901

(22) PCT Filed: Sep. 7, 2009

(86) PCT No.: PCT/IB2009/006771

§ 371 (c)(1),
(2), (4) Date: May 19, 2011

(87) PCT Pub. No.: WO2010/026478

PCT Pub. Date: Mar. 11, 2010

(65) Prior Publication Data

US 2011/0220739 A1 Sep. 15, 2011

(30) Foreign Application Priority Data

Sep. 8, 2008 (JP) ..... 2008-230136

(51) Int. Cl.

| | |
|---|---|
| ***B05B 1/00*** | (2006.01) |
| ***B05B 1/26*** | (2006.01) |
| ***F02M 59/00*** | (2006.01) |
| ***F02M 61/00*** | (2006.01) |

(52) U.S. Cl.

USPC ..... 239/596; 239/533.2; 239/601; 239/504

(58) Field of Classification Search

CPC ..... B05B 1/26; B05B 1/262; B05B 1/3405; B05B 1/34; B05B 1/00; A62C 31/02; F02M 61/00; F02M 63/00; F02M 39/00; F02M 41/00; F02M 43/00; F02M 47/00; F02M 55/00; F02M 59/00

USPC ..... 239/533.2, 533.3, 533.12, 533.14, 596, 239/601, 461, 504, 518

See application file for complete search history.

(56) References Cited

U.S. PATENT DOCUMENTS 5,383,597 A * 1/1995 Sooriakumar et al. ..... 239/5
5,685,491 A * 11/1997 Marks et al. ..... 239/533.12

(Continued)

FOREIGN PATENT DOCUMENTS

DE 631 135 6/1936
DE 100 48 936 4/2002

(Continued)

OTHER PUBLICATIONS

International Search Report issued Dec. 21, 2009 in PCT/IB09/006771 filed Sep. 7, 2009.

*Primary Examiner* — Justin Jonaitis
(74) *Attorney, Agent, or Firm* — Oblon, Spivak, McClelland, Maier & Neustadt, L.L.P.

(57) ABSTRACT

A fuel injection valve of an internal combustion engine includes a measuring plate that has at least one injection hole. Fuel that has flowed along an inner wall surface of the measuring plate flows into the injection hole through an injection hole entrance that is formed in the inner wall surface of the measuring plate, passes through the injection hole, and is injected through an injection hole exit that is formed in an outer wall surface of the measuring plate. A recess is formed from an injection hole entrance rim to an injection hole exit rim in an upstream section of the inner wall surface of the injection hole in a fuel flow direction along the inner wall surface of the measuring plate.

11 Claims, 5 Drawing Sheets

(56) References Cited

U.S. PATENT DOCUMENTS

| | | | | |
|---|---|---|---|---|
| 6,991,188 | B2 * | 1/2006 | Kobayashi et al. | 239/596 |
| 7,066,398 | B2 * | 6/2006 | Borland et al. | 239/102.2 |
| 2004/0046063 | A1 | 3/2004 | Heyse | |
| 2006/0049286 | A1 * | 3/2006 | Oomura et al. | 239/596 |
| 2009/0200402 | A1 * | 8/2009 | Gesk et al. | 239/533.12 |

FOREIGN PATENT DOCUMENTS

| | | |
|---|---|---|
| JP | 2003 314411 | 11/2003 |
| JP | 2005 140055 | 6/2005 |
| JP | 2005 264757 | 9/2005 |
| JP | 2006 105003 | 4/2006 |
| WO | 02 095218 | 11/2002 |

* cited by examiner

FUEL INJECTION VALVE OF INTERNAL COMBUSTION ENGINE

BACKGROUND OF THE INVENTION

1. Field of the Invention

The present invention relates to a fuel injection valve of an internal combustion engine.

2. Description of the Related Art

There is known in the related art that a fuel injection valve of an internal combustion engine includes a measuring plate that has a plurality of injection holes, in which fuel that has flowed along an inner wall surface of the measuring plate passes through the injection holes to the outside. In the fuel injection valve, the injection hole is formed perpendicularly to a plate surface of the measuring plate, a gouged section that expands toward an exit of the injection hole is formed in an upstream inner wall surface section of the injection hole in a fuel flow direction along the inner wall surface of the measuring plate, and thereby facilitating atomization of fuel spray (see Japanese Patent Application Publication No. 2006-105003 (JP-A-2006-105003)).

However, the fuel injection valve needs an improvement in the shape of the inner wall surface of the injection hole for facilitating atomization of fuel spray. Further, in a case that two or more injection holes are formed in the fuel flow direction along the inner wall surface of the measuring plate, and so forth, there is a difference in the flow speed of fuel that flows into the injection hole depending on positions in which the injection holes are formed in the inner wall surface of the measuring plate. This results in unevenness in particle diameters of fuel spray.

SUMMARY OF THE INVENTION

The present invention provides a fuel injection valve of an internal combustion engine that facilitates atomization of fuel spray.

A first aspect of the present invention relates to a fuel injection valve of an internal combustion engine that includes a measuring plate that has at least one injection hole, in which fuel that has flowed along an inner wall surface of the measuring plate flows into the injection hole through an injection hole entrance that is formed in the inner wall surface of the measuring plate, passes through the injection hole, and is injected through an injection hole exit that is formed in an outer wall surface of the measuring plate. In the fuel injection valve, a recess is formed from a rim of the injection hole entrance to a rim of the injection hole exit in an upstream inner wall surface section of the injection hole in a flow direction of the fuel along the inner wall surface of the measuring plate.

In other words, when fuel is injected, the fuel separates from the inner wall surface of the measuring plate at the rim of the injection hole entrance and flows into the injection hole, thereby producing negative pressure in the recess. A part of gases that is present outside the fuel injection valve flows into the recess due to the negative pressure and forms a separation vortex. The shape of the inner wall surface of the injection hole is a recess. This allows inflow gases to flow along the shape of the recess, and thus the gases flow with less resistance. Accordingly, a stronger separation vortex is formed. The separation vortex narrows the flow passage of fuel in the injection hole. This makes fuel form a thin liquid film when it is injected outside. Accordingly, atomization of fuel spray is facilitated.

At least two injection holes of an upstream injection hole and a downstream injection hole may be formed in the fuel flow direction along the inner wall surface of the measuring plate. A maximum radius of curvature of the recess that is formed in the downstream injection hole may be set smaller than a maximum radius of curvature of the recess that is formed in the upstream injection hole.

In other words, in the case that at least two injection holes are formed in the fuel flow direction along the inner wall surface of the measuring plate, the flow speed that fuel flows into the injection hole which is formed in the downstream section is slower than the flow speed that fuel flows into the injection hole which is formed in the upstream section. Therefore, the maximum radius of curvature of the recess that is formed in the downstream injection hole is set smaller than the maximum radius of curvature of the recess that is formed in the upstream injection hole, and thereby making separation vortex that is formed in the downstream injection hole relatively stronger and making separation vortex that is formed in the upstream injection hole relatively weaker. As a result, strengths of formed separation vortices become substantially equal between the upstream and downstream injection holes. Accordingly, unevenness in particle diameters of fuel spray can be reduced.

A plurality of protrusions may be formed at a predetermined interval between the injection hole entrance and the injection hole exit on a wall surface of the recess. At least two injection holes may be formed in the fuel flow direction along the inner wall surface of the measuring plate. Further, the interval between the protrusions that are formed in the downstream injection hole may be set smaller than the interval between the protrusions that are formed in the upstream injection hole.

In other words, in the case that at least two injection holes are formed in the fuel flow direction along the inner wall surface of the measuring plate, as described above, the flow speed that fuel flows into the injection hole which is formed in the downstream section is slower than the flow speed that fuel flows into the injection hole which is formed in the upstream section. Therefore, the interval between the protrusions that are formed in the downstream injection hole is set smaller than the interval between the protrusions that are formed in the upstream injection hole. Accordingly, by the dimple effect that will be described later, strengths of formed separation vortices become substantially equal between the upstream and downstream injection holes. As a result, unevenness in particle diameters of fuel spray can be reduced.

A separation protrusion may be formed in an inner wall surface of the measuring plate around an upstream rim of the injection hole entrance in the fuel flow direction along the inner wall surface of the measuring plate. A cross section of the separation protrusion that is perpendicular to the inner wall surface of the measuring plate may become larger toward a downstream side in the fuel flow direction along the inner wall surface of the measuring plate.

In other words, the separation protrusion, such as the separation protrusion in a wedge shape, is formed in the inner wall surface of the measuring plate around the upstream rim of the injection hole entrance in the fuel flow direction along the inner wall surface of the measuring plate, thereby facilitating a flow separation of fuel that flows into the injection hole.

A second aspect of the present invention relates to a fuel injection valve of an internal combustion engine having a measuring plate that has at least one injection hole, in which fuel that has flowed inward from a section around the measuring plate along an inner wall surface of the measuring plate flows into the injection hole through an injection hole entrance that is formed in the inner wall surface of the measuring plate, passes through the injection hole, and is injected through an injection hole exit that is formed in an outer wall surface of the measuring plate. In the fuel injection valve, a recess is formed from a rim of the injection hole entrance to a rim of the injection hole exit in an outside section of an inner wall surface of the injection hole, in the radial direction of the measuring plate.

In other words, when fuel is injected, the fuel separates from the inner wall surface of the measuring plate at the rim of the injection hole entrance and flows into the injection hole, thereby producing negative pressure in the recess. A part of gases that is present outside the fuel injection valve flows into the recess due to the negative pressure and forms a separation vortex. The shape of the inner wall surface of the injection hole is a recess. This allows inflow gases to flow along the shape of the recess, and thus the gases flow with less resistance. Accordingly, a stronger separation vortex is formed. The separation vortex narrows the flow passage of fuel in the injection hole. This makes fuel form a thin liquid film when the fuel is injected outside. Accordingly, atomization of fuel spray is facilitated.

At least two injection holes may be formed in the measuring plate. A maximum radius of curvature of the recess that is formed in the injection hole which is positioned inside in the radial direction of the measuring plate may be set smaller than a maximum radius of curvature of the recess that is formed in the injection hole which is positioned outside in the radial direction of the measuring plate.

In other words, since fuel flows inward from a periphery of the measuring plate along the inner wall surface of the measuring plate, the flow speed that fuel flows into the injection hole which is formed inside in the radial direction of the measuring plate is slower than the flow speed that fuel flows into the injection hole which is formed outside in the radial direction. Therefore, the maximum radius of curvature of the recess that is formed in the injection hole which is positioned inside in the radial direction of the measuring plate is set smaller than the maximum radius of curvature of the recess that is formed in the injection hole which is positioned outside in the radial direction of the measuring plate, thereby making a separation vortex that is formed in the injection hole which is positioned inside in the radial direction relatively stronger and making a separation vortex that is formed in the injection hole which is positioned outside in the radial direction relatively weaker. As a result, strengths of formed separation vortices become substantially equal between the injection hole which is positioned outside in the radial direction and the injection hole which is positioned inside in the radial direction. Accordingly, unevenness in particle diameters of fuel spray can be reduced.

A plurality of protrusions may be formed at a predetermined interval between the injection hole entrance and the injection hole exit on a wall surface of the recess. At least two injection holes may be formed in the measuring plate. Further, the interval between the protrusions that are formed in the injection hole which is positioned inside in the radial direction of the measuring plate may be set smaller than the interval between the protrusions that are formed in the injection hole which is positioned outside in the radial direction of the measuring plate.

In other words, since fuel flows inward from a periphery of the measuring plate along the inner wall surface of the measuring plate, as described above, the flow speed that fuel flows into the injection hole which is formed inside in the radial direction of the measuring plate is slower than the flow speed that fuel flows into the injection hole which is formed outside in the radial direction. The interval between the protrusions that are formed in the injection hole which is positioned inside in the radial direction of the measuring plate is set smaller than the interval between the protrusions that are formed in the injection hole which is positioned outside in the radial direction of the measuring plate. Accordingly, by the dimple effect that will be described later, strengths of formed separation vortices become substantially equal between the injection hole which is positioned outside in the radial direction and the injection hole which is positioned inside in the radial direction. As a result, unevenness in particle diameters of fuel spray can be reduced.

A separation protrusion may be formed on an inner wall surface of the measuring plate around an outside rim of the injection hole entrance in the radial direction of the measuring plate. A cross section of the separation protrusion that is perpendicular to the inner wall surface of the measuring plate may become larger toward the inside in the radial direction of the measuring plate.

In other words, the separation protrusion, such as the separation protrusion in a wedge shape, is formed in the inner wall surface of the measuring plate around the outside rim of the injection hole entrance in the radial direction of the measuring plate, thereby facilitating a flow separation of fuel that flows into the injection hole.

A third aspect of the present invention relates to a plate that has a fuel injection hole of a fuel injection valve of an internal combustion engine. The plate includes a recess that is formed from a rim of an entrance to a rim of an exit of the fuel injection hole in a section, which is positioned outside in the radial direction of the plate, of an inner wall surface of the fuel injection hole.

The present invention can facilitate atomization of fuel spray.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
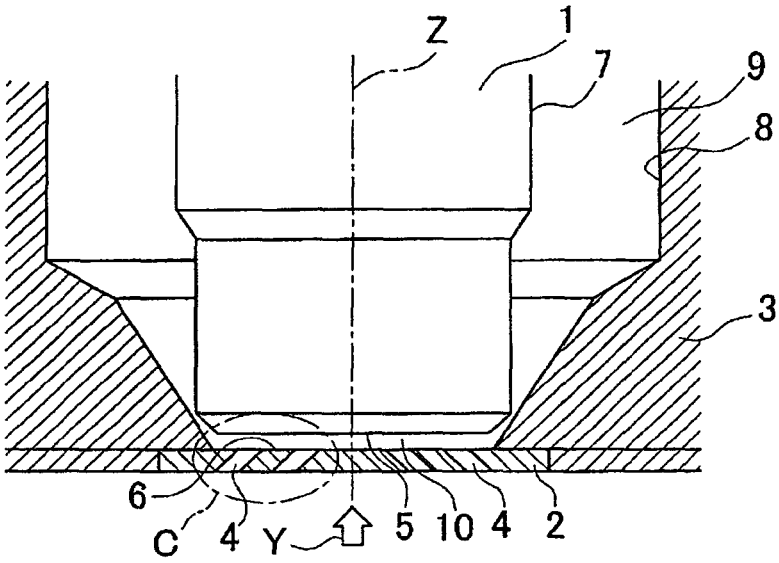
FIG. 1 is a partial sectional view of a fuel injection valve in accordance with an embodiment of the present invention.

Embodiments of the present invention will be described hereinafter with reference to drawings. FIG. 1 shows a construction of a tip of a fuel injection valve. The fuel injection valve of this embodiment is mainly used in an internal combustion engine in which fuel is directly injected into a combustion chamber. However, if work and effect of the fuel injection valve of the present invention that will be described hereinafter is required, this fuel injection valve is applicable to an internal combustion engine in which fuel is not directly injected into the combustion engine (for example, that fuel is injected to an intake port). In each drawing, like reference numerals and symbols denote like objects.

Figure 2:
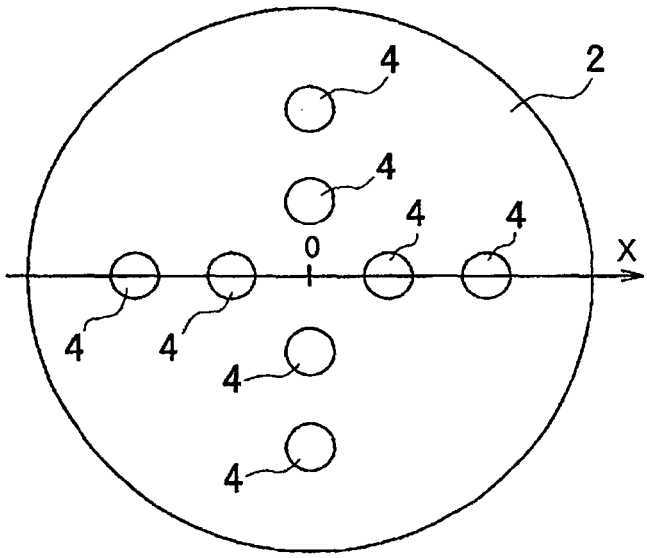
FIG. 2 is a diagram that shows injection holes of the fuel injection valve as seen from the direction of an arrow Y of FIG. 1.

A measuring plate 2 is a circular and generally flat member and has a plurality of injection holes 4 (as shown in FIG. 2, eight injections holes in this embodiment). As shown in FIG. 2, the injection holes 4 includes four outside injection holes that are relatively far from the longitudinal axis Z of the fuel injection valve and are positioned outside in the radial direction, and four inside injection holes that are relatively adjacent to the longitudinal axis Z of the fuel injection valve and are positioned inside in the radial direction. However, the present invention is applicable to a measuring plate that has a different number of the injection holes and a different arrangement.

A needle valve 1 is reciprocated along the axis Z of FIG. 1 in the fuel injection valve (specifically, in a nozzle main body 3) by a known means. An end wall surface 5 of the needle valve 1 is flat. An inner wall surface 6 of the measuring plate 2 is also flat. A lower section of an outer peripheral wall surface 7 of the needle valve 1 can contact with an inner peripheral wall surface 8 of the nozzle main body 3. When the lower section of the outer peripheral wall surface 7 of the needle valve 1 contacts with the inner peripheral wall surface 8 of the nozzle main body 3, the injection holes 4 are blocked due to the lower section of the outer peripheral wall surface 7 of the needle 1, and fuel is not injected from the injection holes 4 in this state. On the other hand, when the lower section of the outer peripheral wall surface 7 of the needle valve 1 is separated from the inner peripheral wall surface 8 of the nozzle main body 3, fuel at high pressure that is stored in a space 9 around the needle valve 1 (that is, a space formed between the outer peripheral wall surface 7 of the needle valve 1 and the inner peripheral wall surface 8 of the nozzle main body 3) flows from a section around the end wall surface 5 of the needle valve 1 into a space 10 that is formed between the end wall surface 5 of the needle valve 1 and the inner wall surface 6 of the measuring plate 2 (hereinafter, referred to as "bottom space"). The fuel flows into the injection holes 4, and finally is injected from the injection holes 4.

Figure 3:
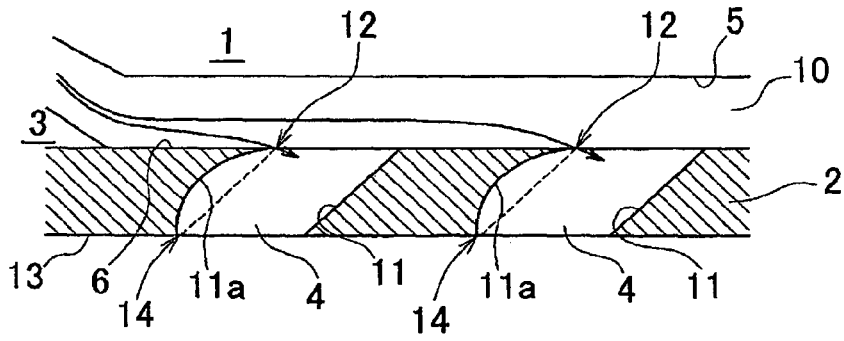
FIG. 3 is an enlarged view of a section of circle C in FIG. 1.

As shown in FIG. 3 that is a cross-sectional view that is taken along the X axis that passes through the centers of the four injection holes 4 that are shown in FIG. 2, when fuel is injected, fuel that has flowed into the bottom space 10 flows along the flat inner wall surface 6 of the measuring plate 2 in a shape of thin film (arrows in the drawing indicate the fuel flow). In other words, fuel flows inward from a periphery of the inner wall surface 6 of the measuring plate 2. When the fuel that flows along the flat inner wall surface 6 of the measuring plate 2 reaches the injection hole 4, the fuel separates from the inner wall surface 6 of the measuring plate 2 at a rim 12 of an entrance of the injection hole 4 (a rim section of a circular rim that is defined by the inner wall surface 6 of the measuring plate 2 and a cylindrical inner wall surface 11 that defines the injection hole 4, which is, particularly, far from the axis Z and adjacent to a section around the end wall surface 5 of the needle valve 1, hereinafter, referred to as "injection hole entrance rim") and flows into the injection hole 4. In other words, fuel flows into the injection hole 4 in a direction along the inner wall surface 6 of the measuring plate 2. When fuel separates form the inner wall surface 6 of the measuring plate 2 and flows into the injection hole 4 in such a manner, atomization of fuel that is injected from the injection hole 4 is facilitated.

In this embodiment, as shown in FIG. 3, the injection hole 4 extends from the inner wall surface 6 to an outer wall surface 13 of the measuring plate 2 in a manner such that the hole extends obliquely to the axis Z and away from the axis Z in the radial direction. That is, the central axis of the injection hole 4 extends from a point on the axis Z toward the radiation direction. An angle that is formed between the direction along the inner wall surface 6 of the measuring plate 2 and the direction that the injection hole 4 extends (the direction that the injection hole 4 extends from the inner wall surface 6 of the measuring plate 2 toward the outer wall surface 13 of the measuring plate 2) is an acute angle. In other words, the injection hole 4 extends from the inner wall surface 6 of the measuring plate 2 to the outer wall surface 13 of the measuring plate 2 so that fuel flows into the injection hole 4 while turning its flow direction from the direction along the inner wall surface 6 of the measuring plate 2 back to a direction at an acute angle. Since the injection hole 4 extends in such a direction, when fuel reaches the injection hole 4 and flows into the injection hole 4, a flow separation of fuel from the injection hole entrance rim 12 of the inner wall surface 11 that defines the injection hole 4 is facilitated. This further facilitates atomization of fuel to be injected.

Further, in this embodiment, a part of a side of the inner wall surface 11 into which fuel flows is gouged, and thereby forming a curved recess 11*a* from the injection hole entrance rim 12 to a rim 14 of a correspondent exit of the injection hole 4 (a rim section of a circular rim that is defined by the outer wall surface 13 of the measuring plate 2 and the cylindrical inner wall surface 11 that defines the injection hole 4, which is, particularly, far from the axis Z, hereinafter, referred to as "injection hole exit rim"). In other words, if the cylindrical inner wall surface 11 before formation of the recess 11*a* is shown by a broken line in FIG. 3, it indicates that the recess 11*a* is formed and thereby making a large space in the injection hole 4 while the same areas of the entrance and exit of the injection hole 4 are retained. The curved shape of the recess 11*a* has a maximum radius of curvature in a cross section as shown in FIG. 3 that passes through the central axes of the injection holes 4 and the X axis that passes through the centers of the four injection holes 4 or the center of the measuring plate 2.

Next, flow of fuel and air in the injection hole 4 during fuel injection will be described with reference to FIG. 4. For convenience, the injection holes 4 will be referred to as injection holes 4*a* and 4*b*. The injection hole 4*a* is positioned upstream in the fuel flow direction that fuel flows inward from the periphery of the inner wall surface 6 of the measuring plate 2. The injection hole 4*b* is positioned downstream. In this embodiment, since fuel flows inward from the periphery to near the center along the inner wall surface 6 of the measuring plate 2, "the fuel flow direction along the inner wall surface of the measuring plate 2" has the same meaning as "the radial direction of the measuring plate 2". "Upstream" and "downstream" in the fuel flow direction along the inner wall surface of the measuring plate 2 have respectively the same meaning as "outside" and "inside" in the radial direction of the measuring plate 2. Accordingly, in the following descriptions, "the fuel flow direction along the inner wall surface of the measuring plate 2" and "upstream" and "downstream" will be used as expressions that describe relative positions.

First, descriptions will be made about the injection hole 4*a* as an example. As described above, fuel that has flowed along the inner wall surface 6 of the measuring plate 2 separates from the inner wall surface 6 of the measuring plate 2 at the injection hole entrance rim 12 and flows into the injection hole 4*a* when fuel is injected. At this point, a flow separation causes negative pressure in a section of the inner wall surface 11 of the injection hole 4*a* into which fuel flows, in other words, in the recess 11*a*. A part of gases that is present outside the fuel injection valve flows into the recess 11*a* due to the negative pressure and forms a separation vortex A. Here, the inner wall surface 11 of the injection hole 4*a* is formed into a recessed shape, and thus gases that has flowed therein flows along the shape of the recess. Accordingly, the injection hole has small resistance and large space compared to a cylindrical inner wall surface of the related art, and a strong separation vortex A is formed. A spotted area F in the injection hole 4*a* of FIG. 4 is an area that fuel fills when fuel flows into the injection hole 4 (hereinafter, referred to as "fuel area"). The separation vortex A narrows the flow passage of fuel in the injection hole. This makes fuel form a thin liquid film when the fuel is injected outside. Accordingly, atomization of fuel spray is facilitated. A strong separation vortex A has a strong cutting power at a border to the fuel area F. This facilitates atomization of fuel spray.

Figure 11:
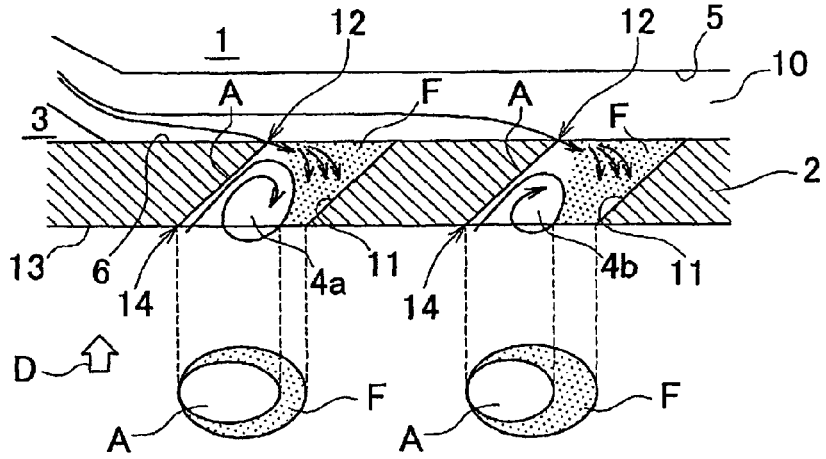
FIG. 11 RELATED ART
FIG. 11 is a view that shows injection holes in the fuel injection valve of a related art during fuel injection.

Diagrams of the injection holes 4*a* and 4*b* during fuel injection as seen from the direction of arrow D are provided below the above-described cross-sectional view of FIG. 4. To compare with this, a fuel injection valve with injection holes that has a cylindrical inner wall surface of the related art is shown in FIG. 11 in a similar manner. Comparing the shapes of the fuel areas F of the injection holes 4*a* and 4*b* as seen from the direction of arrow D, the fuel area F of FIG. 4 has a thinner crescent shape than the fuel area F of FIG. 11. In other words, injected fuel forms a thinner liquid film, and this facilitates atomization of fuel spray.

Further, comparing the shapes of the fuel areas F between the upstream injection hole 4*a* and the downstream injection hole 4*b*, the fuel area F of the upstream injection hole 4*a* has a thin crescent shape compared to the fuel area F of the downstream injection hole 4*b*. This state occurs because a less speed reduction occurs to the fuel flow speed that fuel flows into the upstream injection hole 4*a* than to the fuel flow speed that fuel flows into the downstream injection hole 4*b*, and thus the fuel flow speed into the upstream injection hole 4*a* is faster. Therefore, a strong separation vortex A is formed and narrows the flow passage of fuel in the upstream injection hole 4*a*. Accordingly, atomization of fuel spray can be facilitated compared to the fuel injection valve of the related art that is shown in FIG. 11. However, particle diameters of fuel spray that is injected from the upstream injection hole 4*a* are smaller than particle diameters of fuel spray that is injected from the downstream injection hole 4*b*, and particle diameters are uneven between the injection holes.

Figure 5:
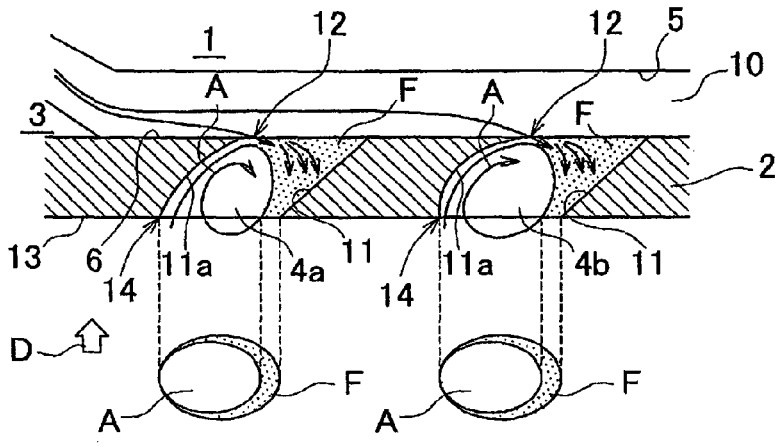
FIG. 5 is a view that shows the injection holes in the fuel injection valve in accordance with another embodiment of the present invention during fuel injection.

About this problem, the above-described mechanism for enhancing a separation vortex facilitates the formation of a separation vortex A and the production of a stronger separation vortex A when the maximum radius of curvature of the recess 11*a* is smaller, in other words, when the curvature of the recess 11*a* is larger. Thus, as shown in FIG. 5, the maximum radius of curvature of the recess 11*a* of the downstream injection hole 4*b* is set smaller than the maximum radius of curvature of the recess 11*a* of the upstream injection hole 4*a*. In other words, the inner wall surface 11 of the downstream injection hole 4*b* is recessed more deeply than the inner wall surface 11 of the upstream injection hole 4*a*, thereby making the space in the injection hole larger. By adjusting the maximum radius of curvature, strengths of formed separation vortices A can be made substantially equal between the injection hole 4*a* that the flow speed of inflowing fuel is faster but the maximum radius of curvature is larger and the injection hole 4*b* that the flow speed of inflowing fuel is slower but the maximum radius of curvature is smaller. As a result, the shapes of the fuel areas F, in other words, the shapes of liquid films can be made substantially equal. This facilitates atomization of fuel spray and allows reduction in unevenness in particle diameters of fuel spray.

The maximum radius of curvature of each injection hole that is optimum for adjusting the strength of the separation vortex A is determined in advance by an experiment or calculation based on a position of each injection hole in the measuring plate 2, in other words, based on the flow direction and flow speed of fuel that flows into each injection hole along the inner wall surface 6 of the measuring plate 2.

Figure 6:
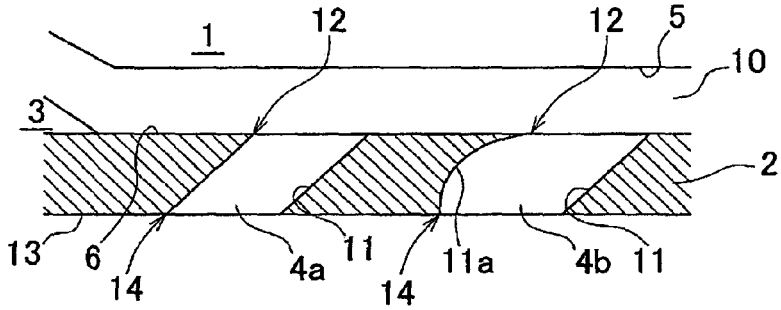
FIG. 6 is a view that shows the injection holes in the fuel injection valve in accordance with yet another embodiment of the present invention.

FIG. 6 shows an exemplary application that the maximum radius of curvature is adjusted and thereby the particle diameter of the fuel spray is adjusted. The upstream injection hole 4*a* is an injection hole that has the conventional cylindrical inner wall surface which has no recess. The downstream injection hole 4*b* is the injection hole that has the recess 11*a*. With such a construction, the particle diameter of fuel spray that is injected from the upstream injection hole 4*a* is intentionally made larger than the particle diameter of fuel spray that is injected from the downstream injection hole 4*b*. Accordingly, a high injection rate (a fuel injection amount per unit time) can be obtained by injection from the upstream injection hole 4*a*, and at the same time atomized fuel spray can be obtained by injection from the downstream injection hole 4*b*. Therefore, fuel injected from the whole fuel injection valve includes fuel spray with large penetration and large particle diameters from the upstream injection hole 4*a* which is positioned outside and fuel spray with small penetration and small particle diameters from the downstream injection hole 4*b* which is positioned inside.

It can be considered that the embodiment that is shown in FIG. 6 is a modification of such an embodiment that is shown in FIG. 5 and that the maximum radius of curvature of the upstream injection hole 4*a* is made larger than the maximum radius of curvature of the downstream injection hole 4*b*, in which the maximum radius of curvature of the upstream injection hole 4*a* is set to infinity.

Figure 7:
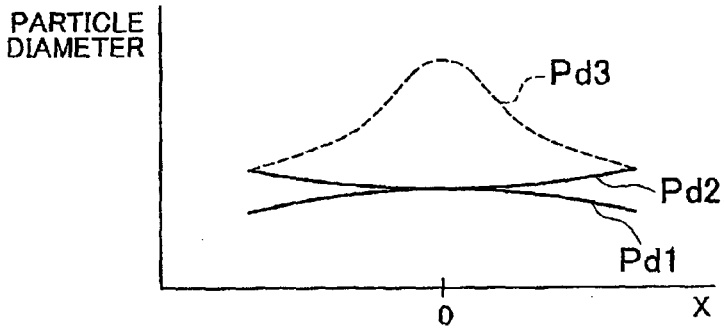
FIG. 7 is a graph that illustrates the relationship between position of the injection hole and particle diameter.

FIG. 7 is a graph that illustrates the relationship between a position on the X axis on the measuring plate 2 that is shown in FIG. 2 and on which the centers of the injection holes are disposed and the particle diameter of fuel spray that is injected at the position on the X axis. As shown in FIG. 2, the center of the measuring plate 2 is the origin of the X axis. A curve Pd1 indicates that the maximum radius of curvature is adjusted as shown in FIG. 5 and strengths of separation vortices are made substantially equal. A curve Pd2 indicates that the maximum radius of curvature of the recess 11*a* is set to infinity as shown in the upstream injection hole 4*a* of FIG. 6 at both ends that are largest and smallest values on the X axis, and that the maximum radius of curvature of the recess 11*a* is set smaller in the injection hole near the center of the measuring plate 2. A curve Pd3 indicates that the injection hole has the cylindrical inner wall surface as shown in the related art of FIG. 11 regardless of a position on the X axis. Comparing between the curves Pd1 and Pd3, atomization is highly facilitated, and the unevenness in particle diameters according to a position in the measuring plate 2 is very small. Referring to the curve Pd2, since the particle diameter becomes smaller toward the center of the measuring plate 2, it can be assumed that the penetration becomes smaller than outside positions.

In JP-A-2006-105003, the gouged section is formed from the central section of the inner wall surface to the outer wall surface of the injection hole of the measuring plate. However, as it is obvious from a cross-sectional view of the fuel injection valve that is shown in FIG. 4 of JP-A-2006-105003, the inner wall surface of the injection hole is not a recess but a protruding shape. Therefore, it is apparent that the present invention has a more optimum shape for forming a stronger separation vortex.

Figure 4:
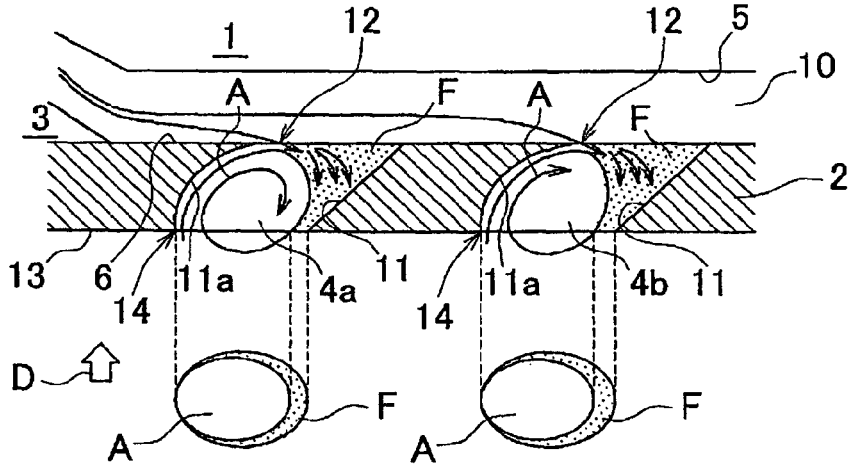
FIG. 4 is a view similar to FIG. 3 that shows the injection holes in the fuel injection valve in accordance with the embodiment during fuel injection.
Figure 8:
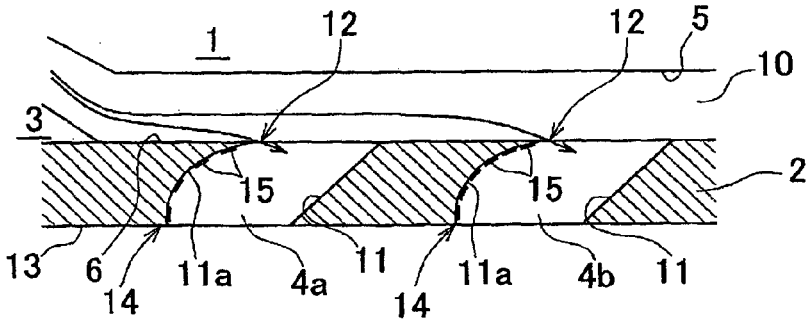
FIG. 8 is a view that shows the injection holes in the fuel injection valve in accordance with yet another embodiment of the present invention.
Figure 9A:
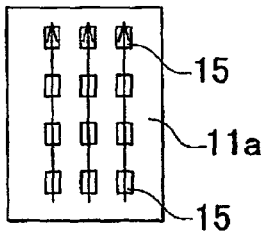
FIGS. 9A and 9B are views that show protrusions that are formed on wall surfaces of recesses in the injection holes.
Figure 9B:
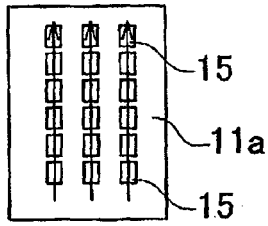

In an embodiment that is shown in FIG. 8, a plurality of protrusions 15 in a rectangular cuboid shape are formed on a wall surface of the recess 11*a* at a predetermined interval between the entrance and exit of the injection hole 4 in the case that the recesses 11*a* of all the injection holes 4 have the same maximum radius of curvature as shown in FIGS. 3 and 4. The predetermined interval is set larger in the upstream injection hole 4*a* than the downstream injection hole 4*b*. FIGS. 9A and 9B show the wall surface of the recess 11*a*. FIG. 9A shows the wall surface of the recess 11*a* in the upstream injection hole 4*a*. FIG. 9B shows the wall surface of the recess 11*a* in the downstream injection hole 4*b*. The wall surface is expanded into a plane in each of the drawings. In FIGS. 9A and 9B, the upper side corresponds to the entrance of the injection hole and the lower side corresponds to the exit of the injection hole. Therefore, arrows in the drawings depict a part of swirl flow of the separation vortex A that flows along the wall surface of the recess 11*a*.

The plurality of protrusions 15 that are disposed along the flow at the predetermined interval produce the dimple effect, thereby reducing flow resistance on the wall surface of the recess 11*a* against the part of swirl flow that is depicted by the arrows in FIGS. 9A and 9B. The dimple effect is an effect that dimples that are formed on a surface reduces flow resistance of the surface when a flow runs on the surface.

As described above, a less speed reduction occurs to the fuel flow into the upstream injection hole 4*a* than to the fuel flow into the downstream injection hole 4*b*, and thus the fuel flow speed into the upstream injection hole 4*a* is faster. Accordingly, in the case that the maximum radius of curvature is set the same for all the recesses 11*a*, the speed of swirl flow of the separation vortex A that is formed in the upstream injection hole 4*a* is faster than that of the separation vortex A that is formed in the downstream injection hole 4*b*. The interval between the protrusions that are formed in the downstream injection hole 4*b* is set smaller than the interval between the protrusions that are formed in the upstream injection hole 4*a*, and thereby a proportion of decrease in the flow resistance by the dimple effect against the swirl flow of the separation vortex A that is formed in the downstream injection hole 4*b* is set larger. As a result, the speed of swirl flow of the separation vortex A that is formed in the upstream injection hole 4*a* is reduced more, and thus the strength thereof becomes substantially equal to the strength of the separation vortex A that is formed in the downstream injection hole 4*b*. Accordingly, the shapes of the fuel areas F or the shapes of liquid films can be made equal. This facilitates atomization of fuel spray and allows reduction in unevenness in particle diameters of fuel spray.

The protrusion 15 in this embodiment has a rectangular cuboid shape. However, the protrusion 15 may have another shape. The interval, height, and so forth of the protrusions 15 that are optimum for adjusting the strength of the separation vortex A are determined in advance by an experiment or calculation based on a position of each injection hole 4 in the measuring plate 2, in other words, based on the flow direction and flow speed of fuel that flows into each injection hole 4 along the inner wall surface 6 of the measuring plate 2.

In this embodiment, the dimple effect is obtained with use of the protrusions. However, a plurality of recesses may be formed in the wall surface of the recess 11*a* instead of the protrusions, and thereby a similar effect can be obtained.

Figure 10:
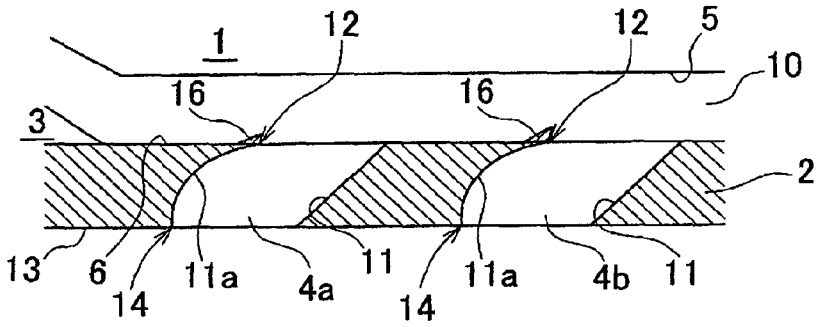
FIG. 10 is a view that shows the injection holes in the fuel injection valve in accordance with still another embodiment of the present invention.

In an embodiment that is shown in FIG. 10, a separation protrusion 16 is formed on a section of the inner wall surface 6 of the measuring plate 2 around the upstream of the injection hole entrance rim 12 in the fuel flow direction along the inner wall surface 6 of the measuring plate 2 in the case that the recesses 11*a* of all the injection holes 4 have the same maximum radius of curvature as shown in FIGS. 3 and 4. In this embodiment, a cross section of the separation protrusion 16 that is perpendicular to the inner wall surface 6 of the measuring plate 2 as shown in FIG. 10 and parallel with the fuel flow direction along the inner wall surface 6 of the measuring plate 2 is a wedge shape. The separation protrusion 16 is disposed in a manner such that a tip of the wedge shape is oriented to the upstream in the fuel flow direction. The separation protrusion 16 can facilitate a separation of fuel flow that flows into the injection hole 4. This allows obtainment of a stronger separation vortex A.

In this embodiment, a separation of the fuel flow along the inner wall surface 6 of the measuring plate 2 is facilitated more when a separation angle that is an angle of the tip of the wedge shape, in other words, when the separation protrusion 16 is higher in the direction that is perpendicular to the measuring plate 2 in FIG. 10. Accordingly, the separation protrusion 16 that is formed around the injection hole entrance rim 12 of the downstream injection hole 4*b* is made higher in the direction that is perpendicular to the measuring plate 2 than the separation protrusion 16 that is formed around the injection hole entrance rim 12 of the upstream injection hole 4*a*, and thereby the strengths of the separation vortices A can be made substantially equal. As a result, the shapes of the fuel areas F, in other words, the shapes of liquid films can be made equal. This facilitates atomization of fuel spray and allows reduction in unevenness in particle diameters of fuel spray.

The separation protrusion 16 of this embodiment has the wedge-shaped cross section. However, the cross section of the separation protrusion 16 may have another shape. For example, the separation protrusion 16 may have an arbitrary shape whose cross section that is perpendicular to the inner wall surface 6 of the measuring plate 2 becomes larger toward the downstream side in the fuel flow direction along the inner wall surface 6 of the measuring plate 2. The separation angle and height of the protrusions 16 that are optimum for adjusting the strength of the separation vortex A are determined in advance by an experiment or calculation based on a position of each injection hole 4 in the measuring plate 2, in other words, based on the flow direction and flow speed of fuel that flows into each injection hole 4 along the inner wall surface 6 of the measuring plate 2.

In the above-described embodiment, the recess is formed in the injection hole that has a cylindrical inner wall surface. However, for example, the recess may be formed in an injection hole that has another shape such as a part of a conical shape, and the configuration of each embodiment may be applied thereto. In the above-described embodiment, the recess is in the curved shape. However, the recess may be in other recessed shape. In a case that other recessed shape is applied, having a large maximum radius of curvature means that the depth of the recess is small, in other words, the space in the gouged shape in the inner wall surface of the injection hole is small. Conversely, having a small maximum radius of curvature means that the depth of the recess is large, in other words, the space in the gouged shape in the inner wall surface of the injection hole is large.

Further, each of the above-described embodiments may be applied in an arbitrary combination. That is, the maximum radius of curvature are set to different values for the recess of the upstream injection hole and the recess of the downstream injection hole as in the embodiment that is shown in FIG. 5. At the same time, the protrusions may be formed on the wall surface of the recess as in the embodiment that is shown in FIG. 8. In addition, the separation protrusion that has the wedge-shaped cross section may be formed on the inner wall surface of the measuring plate around the injection hole entrance rim.

The invention claimed is:

1. A fuel injection valve of an internal combustion engine, comprising:

a nozzle main body;

a needle valve that reciprocates in the nozzle main body; and a plate that has at least two fuel injection holes that are blocked when an outer peripheral surface of the needle valve contacts with an inner peripheral surface of the nozzle main body, wherein a recess is formed from a rim of an entrance to a rim of an exit of at least one of the fuel injection hole in an upstream inner wall of the injection hole in a fuel flow direction along an inner wall surface of the plate, and wherein the at least two injection holes including an upstream injection hole and a downstream injection hole are formed in the fuel flow direction along the inner wall surface of the plate, and a maximum radius of curvature of the recess that is formed in the downstream injection hole is smaller than a maximum radius of curvature of the recess that is formed in the upstream injection hole.

2. The fuel injection valve according to claim 1, wherein a plurality of protrusions are formed at a predetermined interval between the injection hole entrance and the injection hole exit on a wall surface of the recess, and the interval between the protrusions that are formed in the downstream injection hole is smaller than the interval between the protrusions that are formed in the upstream injection hole.

3. The fuel injection valve according to claim 1, wherein a separation protrusion is formed in the inner wall surface of the plate around an upstream rim of the injection hole entrance in the fuel flow direction along the inner wall surface of the plate, and a cross section of the separation protrusion that is perpendicular to the inner wall surface of the plate becomes larger toward a downstream side in the fuel flow direction along the inner wall surface of the plate.

4. The fuel injection valve according to claim 1, wherein a diameter of the injection hole entrance is equal to a diameter of the injection hole exit.

5. The fuel injection valve according to claim 1, wherein an axis of the injection hole is inclined with respect to an axis of the fuel injection valve.

6. A fuel injection valve of an internal combustion engine, comprising:

a nozzle main body;

a needle valve that reciprocates in the nozzle main body; and a plate that has at least two fuel injection holes that are blocked when an outer peripheral surface of the needle valve contacts with an inner peripheral surface of the nozzle main body, wherein a recess is formed from a rim of an entrance to a rim of an exit of at least one of the fuel injection hole in an outside section of an inner wall surface of the fuel injection hole, in the radial direction of the plate, and wherein the at least two injection holes are formed in the plate, and a maximum radius of curvature of the recess that is formed in the injection hole which is positioned inside in the radial direction of the plate is smaller than a maximum radius of curvature of the recess that is formed in the injection hole which is positioned outside in the radial direction of the plate.

7. The fuel injection valve according to claim 6, wherein a plurality of protrusions are formed at a predetermined interval between the injection hole entrance and the injection hole exit on a wall surface of the recess, and the interval between the protrusions that are formed in the injection hole which is positioned inside in the radial direction of the plate is smaller than the interval between the protrusions that are formed in the injection hole which is positioned outside in the radial direction of the plate.

8. The fuel injection valve according to claim 6, wherein a separation protrusion is formed on the inner wall surface of the plate around an outside rim of the injection hole entrance in the radial direction of the plate, and a cross section of the separation protrusion that is perpendicular to the inner wall surface of the plate becomes larger toward an inside in the radial direction of the plate.

9. The fuel injection valve according to claim 6, wherein a diameter of the injection hole entrance is equal to a diameter of the injection hole exit.

10. The fuel injection valve according to claim 6, wherein an axis of the injection hole is inclined with respect to an axis of the fuel injection valve.

11. A plate that has at least two fuel injection holes of a fuel injection valve of an internal combustion engine, comprising:

a recess that is formed from a rim of an entrance to a rim of an exit of at least one of the fuel injection hole in a section, which is positioned outside in the radial direction of the plate, of an inner wall surface of the fuel injection hole;

wherein the least two injection holes are formed in the plate, and a maximum radius of curvature of the recess that is formed in the injection hole which is positioned inside in the radial direction of the plate is smaller than a maximum radius of curvature of the recess that is formed in the injection hole which is positioned outside in the radial direction of the plate.

* * * * *